US011819078B1

(12) United States Patent
Johnson

(10) Patent No.: US 11,819,078 B1
(45) Date of Patent: Nov. 21, 2023

(54) SUSPENDER ATTACHMENT DEVICE

(71) Applicant: Suspender Mender, LLC, Niantic, CT (US)

(72) Inventor: Kevin Charles Johnson, Niantic, CT (US)

( * ) Notice: Subject to any disclaimer, the term of this patent is extended or adjusted under 35 U.S.C. 154(b) by 0 days.

(21) Appl. No.: 17/404,348

(22) Filed: Aug. 17, 2021

Related U.S. Application Data

(60) Provisional application No. 63/066,450, filed on Aug. 17, 2020.

(51) Int. Cl.
*A41F 3/02* (2006.01)
*A41F 3/04* (2006.01)
*A41F 11/14* (2006.01)

(52) U.S. Cl.
CPC ..... *A41F 3/02* (2013.01); *A41F 3/04* (2013.01); *A41F 11/14* (2013.01)

(58) Field of Classification Search
CPC .... A41F 3/02; A41F 3/04; A41F 11/14; A41F 3/00; A44B 11/04; Y10T 24/47; Y10T 24/4755; Y10T 24/4091; Y10T 24/4088; Y10T 24/4093
USPC ..... 2/340, 336; 24/265 R, 265 H, 199; D11/210; 450/88
See application file for complete search history.

(56) References Cited

U.S. PATENT DOCUMENTS 428,820 A 5/1890 Stafford
457,448 A 8/1891 Clawson
535,227 A 3/1895 Slaughter, Jr.
587,922 A 8/1897 Blankenship
1,256,580 A 2/1918 Leighton
1,914,301 A * 6/1933 Schottenfels ..... A41F 1/006 450/83
2,212,862 A * 8/1940 Hirsh ..... A44B 11/04 24/336
3,161,931 A 12/1964 Zif
4,457,051 A 7/1984 Bartolini
D350,712 S * 9/1994 D'Ambrosio ..... A41F 3/02 D11/218
D356,658 S * 3/1995 Bernart ..... D2/624
(Continued)

FOREIGN PATENT DOCUMENTS

GB 190326281 A 9/1904
GB 2504215 A * 1/2014 ..... A41F 1/00

*Primary Examiner* — Amy Vanatta
(74) *Attorney, Agent, or Firm* — John Rizvi; John Rizvi, P.A.—The Patent Professor®

(57) ABSTRACT

A suspender attachment device interconnected to an end of a suspender strap and operative to securely yet releasably attach the suspender strap to a belt loop on a pair of pants. The device includes a suspender interconnect portion having an interconnect channel dimensioned to receive the end of the suspender strap therethrough and to retain the end of the suspender strap therein. The device also includes a belt loop attachment portion having an attachment channel dimensioned and configured to receive and releasably retain the belt loop therein, the belt loop attachment portion is connected to the suspender interconnect portion. A guide portion having a guide channel is disposed in communication with the attachment channel, the guide channel dimensioned and configured to facilitate disposition of the belt loop into and out of the attachment channel by a user.

2 Claims, 8 Drawing Sheets

(56) References Cited

U.S. PATENT DOCUMENTS

| | | | | | |
|---|---|---|---|---|---|
| 5,432,985 | A | * | 7/1995 | Bernart | A44B 11/04 24/265 AL |
| 6,006,365 | A | * | 12/1999 | Strandberg | A41F 3/00 2/310 |
| 6,088,839 | A | * | 7/2000 | Utamaru | A41F 3/02 2/326 |
| 6,179,687 | B1 | * | 1/2001 | Lee | A41F 15/002 450/88 |
| 8,555,421 | B2 | | 10/2013 | Herman | |
| D811,690 | S | * | 3/2018 | Berte | D2/640 |
| D815,982 | S | * | 4/2018 | Chang | D11/208 |
| D818,391 | S | * | 5/2018 | Chang | A44B 11/02 D8/356 |
| D848,899 | S | * | 5/2019 | Chang | D11/210 |
| D896,695 | S | * | 9/2020 | Falvai | A41F 1/006 D11/218 |
| D945,738 | S | * | 3/2022 | Morgan | A41F 3/00 D2/639 |
| 2002/0077029 | A1 | | 6/2002 | Fildan et al. | |
| 2012/0090078 | A1 | | 4/2012 | Von Olnhausen | |
| 2016/0106167 | A1 | * | 4/2016 | Loshinsky | A41B 9/00 2/323 |
| 2018/0343982 | A1 | * | 12/2018 | Chang | A44B 11/02 |
| 2020/0323298 | A1 | | 10/2020 | Morgan | |
| 2022/0007768 | A1 | * | 1/2022 | Morgan | A41F 3/04 |
| 2022/0030996 | A1 | * | 2/2022 | Wenkman | A41F 9/007 |

* cited by examiner

SUSPENDER ATTACHMENT DEVICE

CROSS-REFERENCE TO RELATED APPLICATIONS

This application claims the benefit of U.S. Provisional Patent Application Ser. No. 63/066,450, filed on Aug. 17, 2020, which is incorporated by reference herein in its entirety.

FIELD OF THE INVENTION

The present invention relates generally to an improved suspender attachment device.

BACKGROUND OF THE INVENTION

Suspenders provide an alternative mechanism for many people to secure a pair of pants to his or her person, in lieu of a belt. Belts can prove uncomfortable for many persons, and in some cases, they can prove to be problematic, for example, for persons with poor circulation. Further, in some cases, a belt simply and perhaps seriously detracts from the overall appearance of a clothing ensemble by creating an unwanted horizontal break line.

Most people are familiar with the appearance of a pair of suspenders having large, bulky alligator type clips being attached to opposite sides of a waistband on the front of a pair of pants. Similarly, most people are likely familiar with the fact that the suspender straps may be separately attached to different portions of the waist band on the back of the pair of pants, or that the suspender straps may be joined to a single strap and attached to a single point of the waist band on the back of a pair of pants. Suspender straps typically include a strap adjuster which allows a user to adjust the overall length of a suspender strap so as to properly fit the wearer.

What many people may not know, unless they have actually attempted to don a pair of suspenders themselves, the process is not always a simple one. For example, while adjusting one suspender strap, it is not uncommon for a strap to become unattached from the front or back of the pants as a result of the tension being applied during adjustment. Further, once the pants are on the user, it is often difficult if not impossible for a user to properly reattach a suspender strap that has become detached from the back of the pants. Even when properly attached, it is not uncommon for suspenders to inadvertently become detached, particularly while a wearer is moving about, which is at a minimum a nuisance, and which can create potentially embarrassing situation for the wearer.

Furthermore, the tried and true alligator type clips still found on a many suspenders today are actually detrimental to the clothes they are attached to, such as by snagging, ripping or even tearing through the fabric. In addition, the alligator clips are typically bulky and are a source of discomfort at the point of attachment for many wearers. The movable and often spring loaded mechanism which retains the alligator clip in place is also subject to breakage and failure, and over time, can simply wear out.

A number of solutions have been proposed to address the issues related to attaching suspender straps to a pair of pants. One proposed solution requires time-consuming modification to pants, and it remains difficult to attach and detach quickly and easily. Another proposed solution is difficult to attach in a symmetric fashion on the back of the wearer, does not have a low profile, and it remains subject to detaching and causing damage to the pant fabric.

Another proposed solution is bulky, heavy, unfashionable, and does not have a low profile. Yet another proposed solution requires that the wearer use in combination with a belt, is bulky, and does not have a low profile, and essentially defeats the purpose of wearing suspenders at all.

Accordingly, there is an established need for a solution to one or more of the problems identified above for attaching suspender straps to a pair of pants.

SUMMARY OF THE INVENTION

The present invention is directed generally to an improved suspender attachment device.

In a first implementation of the invention, a suspender attachment device interconnected to an end of a suspender strap and operative to securely yet releasably attach the suspender strap to a belt loop on a pair of pants may comprise: a suspender interconnect portion having an interconnect channel dimensioned to receive the end of the suspender strap therethrough and to retain the end of the suspender strap therein; a belt loop attachment portion having an attachment channel dimensioned and configured to receive and releasably retain the belt loop therein, the belt loop attachment portion is connected to the suspender interconnect portion; and, a guide portion having a guide channel is disposed in communication with the attachment channel, the guide channel dimensioned and configured to facilitate disposition of the belt loop into and out of the attachment channel by a user.

In a second aspect, the suspender attachment device can include a belt loop attachment portion connected to a suspender interconnect portion via an attachment portion interface.

In another aspect, the suspender attachment device may have a suspender interconnect portion and a belt loop attachment portion integrally constructed with one another.

In a further aspect, the suspender attachment device can be formed from a sheet of metal.

In one other aspect, the suspender attachment device may be molded from plastic.

In yet another aspect, the suspender attachment device can include an interconnect channel at least partially defined by an interconnect channel length.

In still one further aspect, the suspender attachment device may have an attachment channel at least partially defined by an attachment channel length.

In yet one other aspect, the suspender attachment device can include an interconnect channel length which is greater than an attachment channel length.

In still another aspect, the suspender attachment device may have an interconnect channel at least partially defined by an interconnect channel central axis.

In yet one further aspect, the suspender attachment device can include an attachment channel at least partially defined by an attachment channel central axis.

In still one other aspect, the suspender attachment device may have an interconnect channel central axis and said attachment channel central axis are substantially parallel with one another.

In yet another aspect, the suspender attachment device can include a guide channel having a first guide channel disposed in communication with a second guide channel via a guide channel interface.

In still one further aspect, the suspender attachment device may have a second guide channel at least partially defined by a second guide channel central axis.

In yet one other aspect, the suspender attachment device can include a second guide channel central axis being substantially perpendicular to an attachment channel central axis to facilitate releasably retaining the belt loop in an attachment channel.

In still another aspect, the suspender attachment device may have a guide channel including a guide surface to facilitate disposition of the belt loop between a first guide channel and a second guide channel.

In yet one further aspect, a suspender attachment device interconnected to an end of a suspender strap and operative to securely yet releasably attach the suspender strap to a belt loop on a pair of pants may comprise: a suspender interconnect portion having an interconnect channel dimensioned to receive the end of the suspender strap therethrough and to retain the end of the suspender strap therein, the interconnect channel at least partially defined by an interconnect channel central axis; a belt loop attachment portion having an attachment channel dimensioned to receive and releasably retain the belt loop therein, the attachment channel at least partially defined by an attachment channel central axis; the belt loop attachment portion connected to the suspender interconnect portion via an attachment portion interface; a guide portion having a guide channel disposed in communication with the attachment channel, the guide channel dimensioned and configured to facilitate disposition of the belt loop into and out of the attachment channel; the guide channel having a first guide channel disposed in communication with a second guide channel, the second guide channel at least partially defined by a second guide channel central axis; and, the second guide channel central axis is substantially perpendicular to the attachment channel central axis to facilitate releasably retaining the belt loop in the attachment channel.

In still one other aspect, a suspender attachment device interconnected to an end of a suspender strap and operative to securely yet releasably attach the suspender strap to a belt loop on a pair of pants may comprise: a suspender interconnect portion having an interconnect channel dimensioned to receive the end of the suspender strap therethrough and to retain the end of the suspender strap therein, the interconnect channel at least partially defined by an interconnect channel length having an interconnect channel central axis therethrough; a belt loop attachment portion having an attachment channel dimensioned to receive and releasably retain the belt loop therein, the attachment channel at least partially defined by an attachment channel length having an attachment channel central axis therethrough; the suspender interconnect portion and the belt loop attachment portion are integrally constructed; the interconnect channel length is greater than the attachment channel length; the interconnect channel central axis and the attachment channel central axis are substantially parallel with one another; a guide portion having a guide channel disposed in communication with the attachment channel, the guide channel dimensioned and configured to facilitate disposition of the belt loop into and out of the attachment channel; the guide channel having a first guide channel disposed in communication with a second guide channel, the second guide channel at least partially defined by a second guide channel central axis; and, the second guide channel central axis is substantially perpendicular to the attachment channel central axis to facilitate releasably retaining the belt loop in the attachment channel.

These and other objects, features, and advantages of the present invention will become more readily apparent from the attached drawings and the detailed description of the embodiments, which follow.

BRIEF DESCRIPTION OF THE DRAWINGS

The embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper". "lower", "top", "bottom", "left", "right", "front". "rear", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed to a suspender attachment device, generally as shown as at 100 throughout the figures. More in particular, the present invention is directed to a suspender attachment device 100 to facilitate quickly and easily releasably interconnecting a suspender strap to a belt loop on a pair of pants being worn by a user. In at least one embodiment, the present suspender attachment device 100 comprises a unitary construction without any moving parts. In one further embodiment, the present suspender attachment device 100 comprises a low profile configuration to minimize the perception of the presence of device 100 by a wearer, which increases comfort. More in particular, the low profile configuration minimizes the appearance of the device 100 when worn either on top or underneath clothing, making the present suspender attachment device 100 more discreet and acceptable to wear in any setting, and it makes the suspenders easier to pack, store, and travel with.

Figure 1:
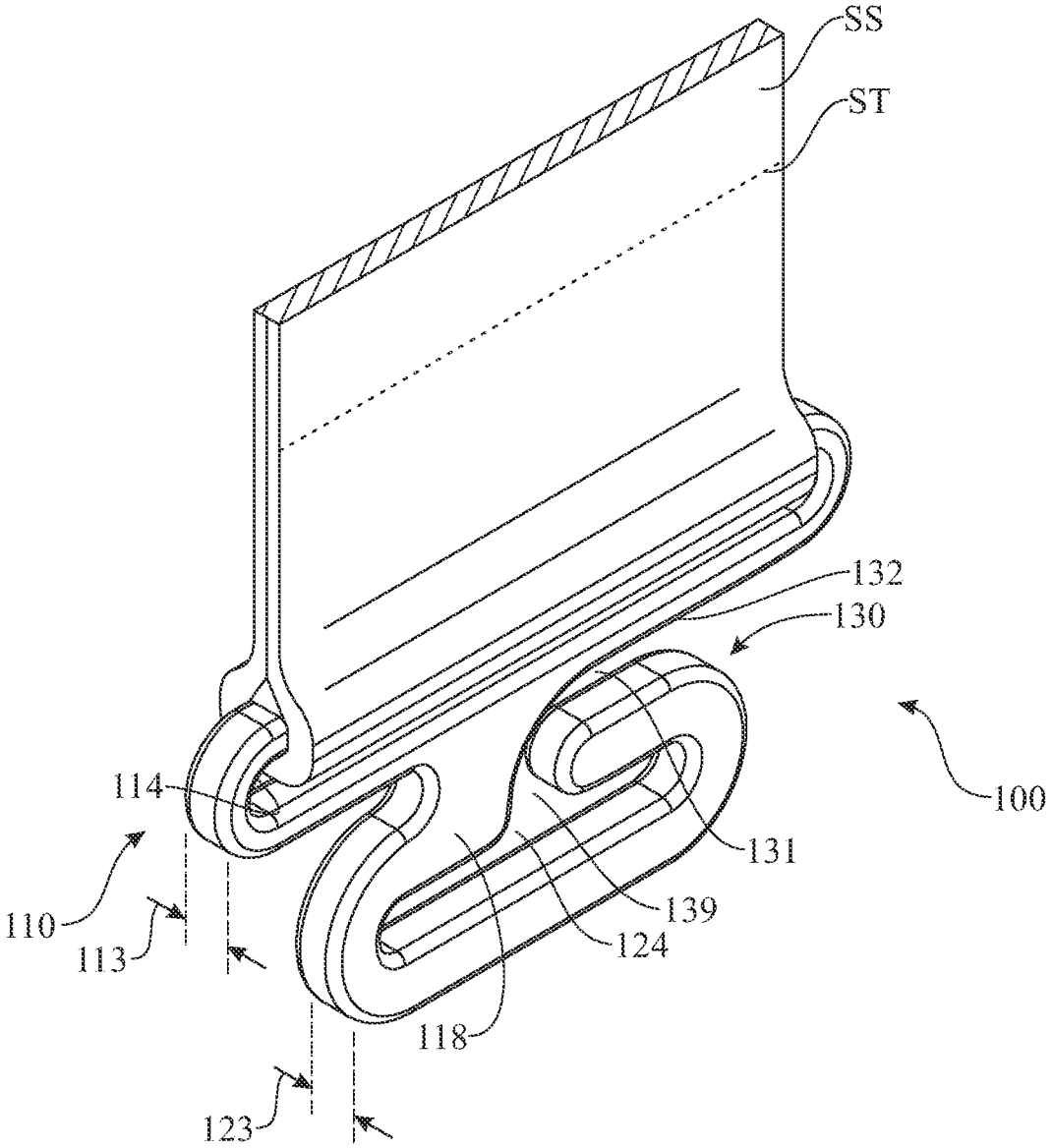
FIG. 1 presents a front perspective view of one illustrative embodiment of a suspender attachment device interconnected to one end of a suspender strap, in accordance with the present invention.
Figure 2:
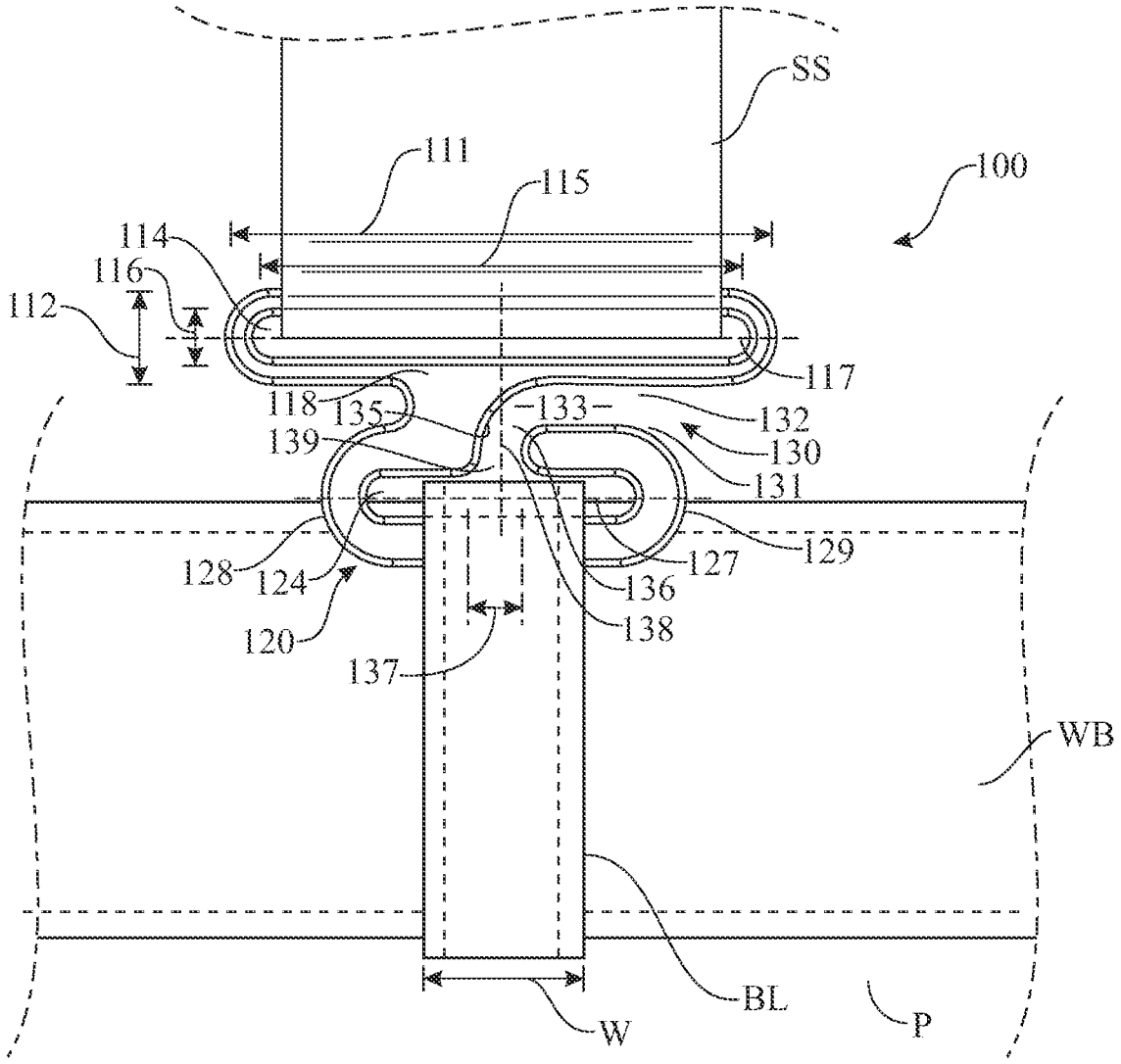
FIG. 2 presents an elevation of the suspender attachment device of FIG. 1 attached to a belt loop on a pair of pants, in accordance with the present invention.

Referring initially to FIGS. 1 and 2, front perspective and elevation views, respectively, of one illustrative embodiment of a suspender attachment device 100 interconnected to one end of a suspender strap are presented. Turning first to FIG. 1, a suspender attachment device 100 in accordance with at least one embodiment of the present invention includes a suspender interconnect portion 110. As may be seen from FIG. 1, suspender interconnect portion 110 includes an interconnect channel 114 formed therethrough. As also shown in FIG. 1, the interconnect channel 114 is dimensioned and configured to receive and retain one end of a suspender strap SS therein. More in particular, in at least one embodiment, a loose end of a suspender strap SS is passed through an interconnect channel 114 of a suspender interconnect portion 110 and is secured to the suspender strap SS itself such as, by way of example only, stitching ST, as shown in FIG. 1. It is to be appreciated that any of a number of mechanical fastening mechanisms may be employed to secure a loose end of a suspender strap to the suspender strap itself, thereby forming a loop through an interconnect channel 114 of a suspender interconnect portion 110 of a suspender attachment device 100, thereby securing the suspender strap thereto, in accordance with the present invention.

A suspender interconnect channel 114 in one embodiment is at least partially defined by an interconnect channel length 115. In accordance with one embodiment, an interconnect channel length 115 is about 0.5 inch to about 2.0 inches. A corresponding interconnect portion length 111 in at least one embodiment is about 0.75 inch to about 2.25 inch. In one further embodiment, an interconnect channel length 115 is about 0.75 inch to about 1.5 inches. In at least one embodiment, an interconnect channel length 115 is about 1 inch.

A suspender interconnect channel 114 is further defined by an interconnect channel height 116. In accordance with one embodiment, an interconnect channel height 116 is about 0.05 inch to about 0.25 inch. A corresponding interconnect portion height 112 in at least one embodiment is about 0.3 inch to about 0.5 inch. In one further embodiment, an interconnect channel height 116 is about 0.1 inch. An interconnect portion 114 is further defined by an interconnect portion width 113 of about 0.03 inch to about 0.25 inch, or about 0.05 inch to 0.1 inch, and in yet one further embodiment, an interconnect portion width 113 is about 0.074 inch.

With continued reference to FIG. 1, a suspender attachment device 100 in accordance with the present invention further comprises a belt loop attachment portion 120. A belt loop attachment portion 120 is attached to a suspender interconnect portion 110 in at least one embodiment via an attachment portion interface 118, such as is shown by way of example only in FIG. 1. Similar to suspender interconnect portion 110, a belt loop attachment portion 120 includes an attachment channel 124 formed through a portion thereof. As the name implies, a belt loop attachment portion 120 in accordance with the present invention is provided for attachment to a belt loop, such as are typically found on a waistband of a pair of pants. More in particular, an attachment channel 124 of a belt loop attachment portion 120 is configured and dimensioned to receive and releasably retain a belt loop BL therein, such as is shown in the illustrative embodiment of FIG. 2. An attachment channel 124 in one embodiment is at least partially defined by an attachment channel length 125. In accordance with one embodiment, an attachment channel length 125 is about 0.25 inch to about 1.0 inch. A corresponding attachment portion length 121 in at least one embodiment is about 0.5 inch to about 1.25 inches. In one further embodiment, an attachment channel length 125 is about 0.4 inch to about 0.8 inch. In at least embodiment, an attachment channel length 125 is about 0.6 inch.

An attachment channel 124 is further defined by an attachment channel height 126. In accordance with one embodiment, an attachment channel height 126 is about 0.05 inch to about 0.25 inch. A corresponding attachment portion height 122 in at least one embodiment is about 0.3 inch to about 0.5 inch. In one further embodiment, an attachment channel height 126 is about 0.1 inch. An attachment portion 124 is further defined by an attachment portion width 123 of about 0.03 inch to about 0.25 inch, or about 0.05 inch to 0.1 inch, and in yet one further embodiment, an attachment portion width 123 is about 0.074 inch.

A suspender attachment device 100 in accordance with the present invention also includes a guide portion 130. A guide portion 130 includes a guide channel 131 which is disposed in communication with an attachment channel 124 of a belt loop attachment portion 120. A guide channel access 132 is configured and dimensioned to receive a belt loop therethrough and into a guide channel 131 of a guide portion 130. In at least one embodiment, a guide channel 131 includes a first guide channel 133 disposed in communication with a second guide channel 136. A guide channel access 132 in a further embodiment is configured and dimensioned to receive a belt loop therethrough and into a first guide channel 133 of a guide portion 130. In one further embodiment, a guide portion 130 includes a guide surface 135 having a smooth curved configuration to facilitate movement of a belt loop through a guide channel 131, and more in particular, to facilitate movement of a belt loop between a first guide channel 133 and a second guide channel 136.

In one embodiment, a belt loop attachment portion 120 includes a closed attachment channel section 128 and an open attachment channel section 129, such as are shown by way of example in FIG. 2. An open attachment channel section 129, in one embodiment, is disposed in communication with a guide channel 131 of the guide portion 130. In one further embodiment, an open attachment channel section 129 is disposed in communication with a second guide channel 136 of the guide portion 130. As will be appreciated, the arrangement of a closed attachment channel section 128 and an open attachment channel section 129, disposed in communication with a second guide channel 136, such as is shown best in FIG. 2, facilitates retention of a belt loop in an attachment channel 124 of a belt loop attachment portion 120.

More in particular, an interconnect channel 114 of a suspender interconnect portion 110 is at least partially defined by an interconnect channel central axis 117. In addition, an attachment channel 124 of a belt loop attachment portion 120 is at least partially defined by an attachment channel central axis 127. As best seen in the illustrative embodiments of FIGS. 2 and 8, the interconnect channel central axis 117 of interconnect channel 114 is substantially parallel to the attachment channel central access 127 of attachment channel 124. As a result, when the present suspender attachment device 100 having one end of a suspender strap SS interconnected thereto is attached to a belt loop BL of a pair of pants P, the belt loop BL is disposed in and along attachment channel 124 of the belt loop attachment portion 120 bridging a guide channel interface 139 between the attachment channel 124 and second guide channel 136, such as is shown in FIG. 2, thereby preventing the present suspender attachment device 100 from being inadvertently released from the belt loop BL.

As may also be seen from FIG. 2, second guide channel 136 is at least partially defined by a second guide channel width 137 which is considerably less than a width W of belt loop BL. In at least one embodiment, a second guide channel width 137 is about 0.05 inch to about 0.15 inch. In one further embodiment, a second guide channel width 137 is about 0.1 inch. A first guide channel 133 is likewise at least partially defined by a first guide channel width 134. Similar to the second guide channel 136, a first guide channel width 134 in at least one embodiment is about is about 0.05 inch to about 0.15 inch, and in one further embodiment, a first guide channel width 134 is about 0.1 inch.

As will be further appreciated, attachment of a suspender strap to a belt loop with the present suspender attachment device 100 is quickly and easily accomplished by simply aligning a guide channel access 132 with a side of a belt loop, and moving the device 100 over the belt loop and into and through the guide channel 131 and into the attachment channel 124 of the belt loop attachment portion 120. As will be further appreciated from the foregoing, this arrangement prevents the belt loop from inadvertently being released from the attachment channel 124 of the attachment channel 120. Rather, deliberate action of a user is required to feed one end of the belt loop out of attachment channel 124 and into the second guide channel 136 through guide channel interface 139, such that the belt loop may be released from the attachment channel 124 out through the guide channel 131 of the guide portion 130. This is due in part to the fact that the second guide channel central axis 138 is configured to be substantially perpendicular to the attachment channel central axis 127. This is also due in part to the oblong configuration of the attachment channel 124 wherein the attachment channel length 125 is considerably greater than the attachment channel height 126. More in particular, in one embodiment, the attachment channel length 125 is at least three times the attachment channel height 126. In another embodiment, the attachment channel length 125 is at least four times the attachment channel height 126, and in still one further embodiment, the attachment channel length 125 is at least five times the attachment channel height 126.

Figure 3:
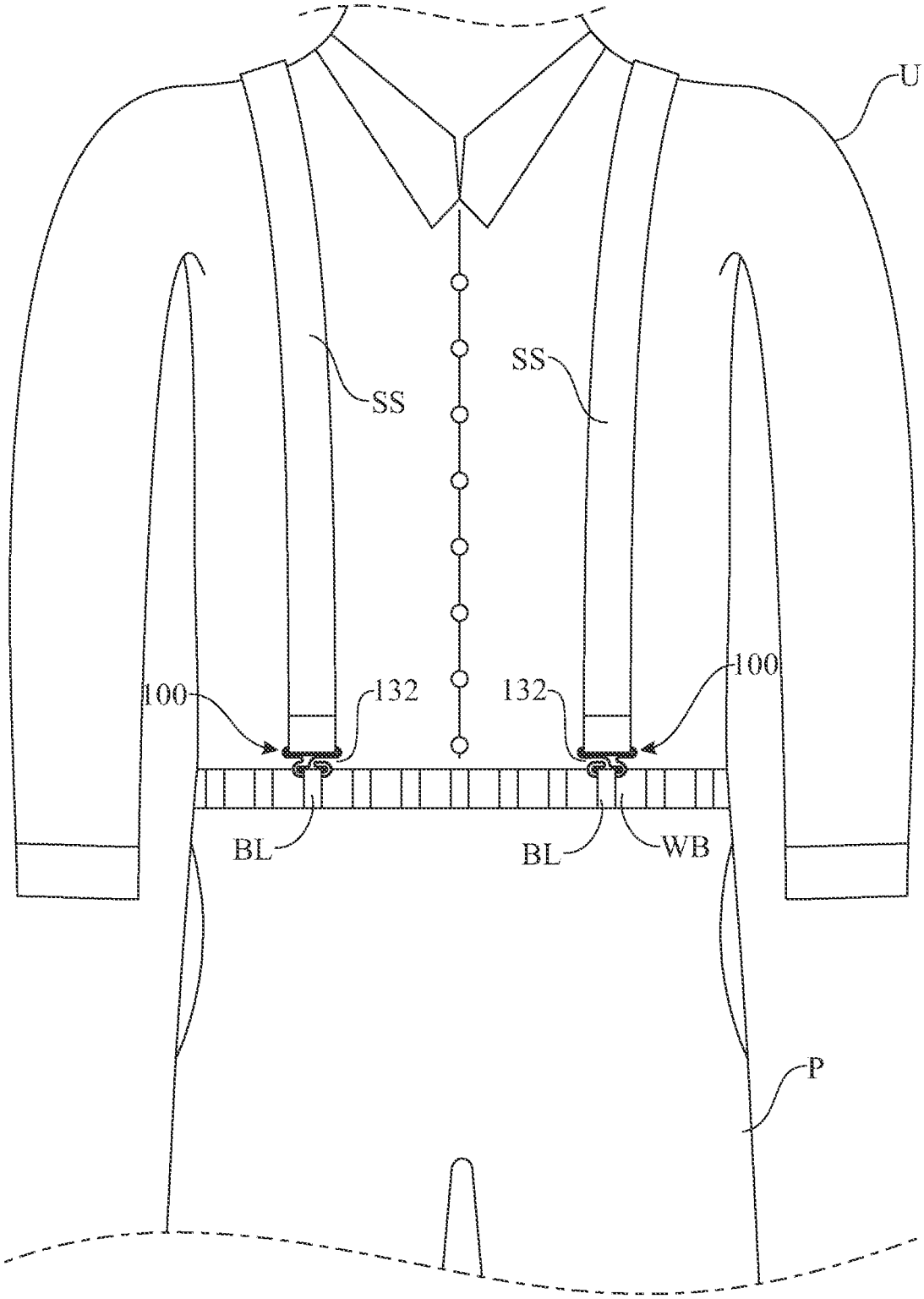
FIG. 3 presents an elevation of a pair of suspender attachment devices as shown in FIG. 1 each attached to a different belt loop on the front of a pair of pants worn by a user, in accordance with the present invention.
Figure 4:
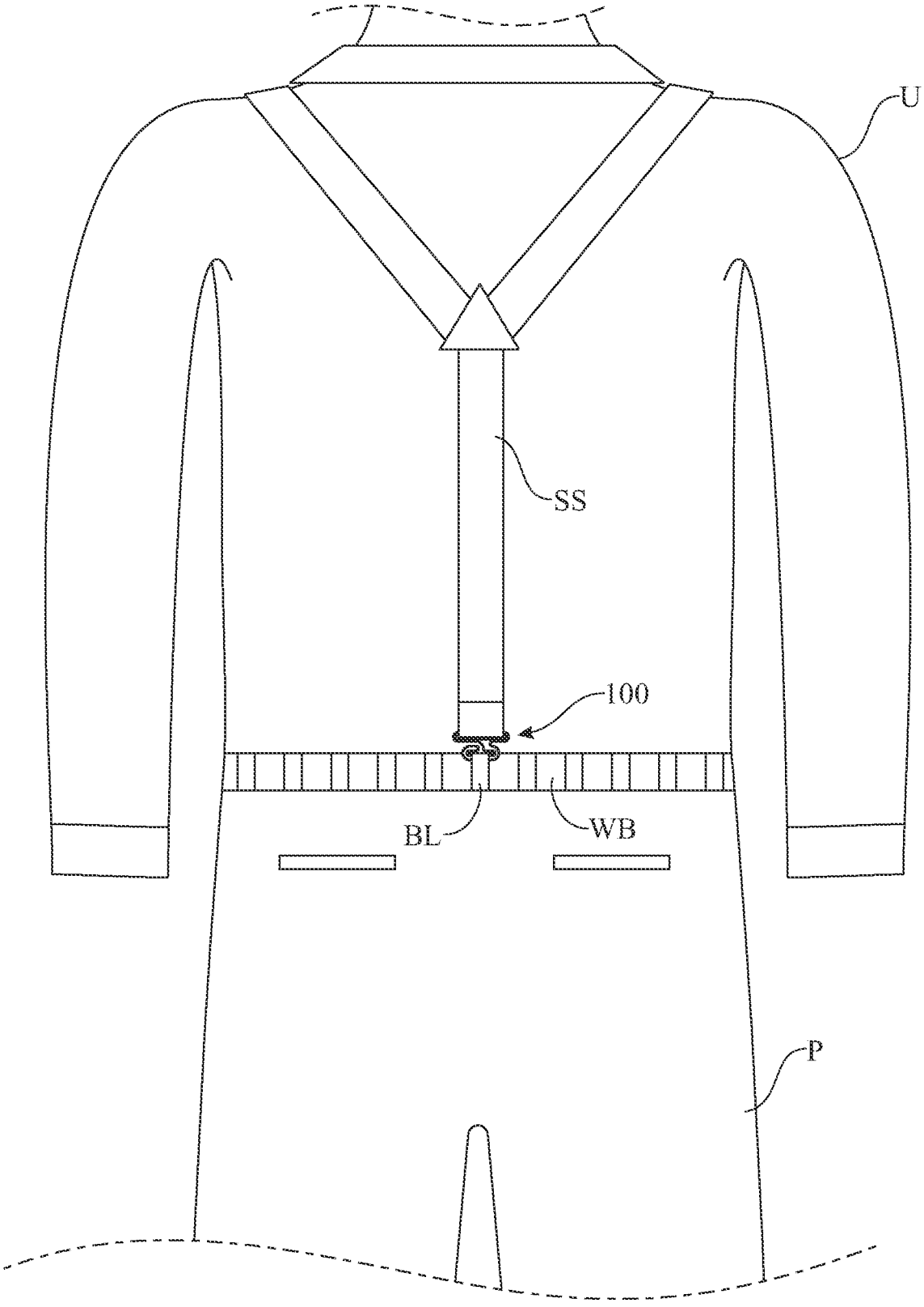
FIG. 4 presents an elevation of a suspender attachment device as shown in FIG. 1 attached to a belt loop on the back of a pair of pants worn by a user, in accordance with the present invention.

It is to be appreciated from the foregoing, that the entire process of attaching the present suspender attachment device 100, having one and of the suspender strap attached thereto, is quickly and easily accomplished without any bulky moving parts. Looking next to the illustrative embodiment of FIG. 3, a pair of suspender straps SS, each having one of the present suspender attachment devices 100 interconnected to a corresponding end thereof, are operatively positioned over the shoulders of a user U and attached to a different corresponding one of the plurality of belt loops BL attached to a waistband WB of a pair of pants P. As may be seen from FIG. 3, in at least one embodiment, it is desirable for the guide channel access 132 of each suspender attachment device 100 to be directed inwardly towards the user's midsection, as this will further serve to prevent inadvertent release of the suspender attachment device 100 from the belt loops. FIG. 4 is the back of the user U of FIG. 3 showing the suspender straps coming over the user's shoulder being joined to a single suspender strap SS having a suspender attachment device 100 interconnected to an end thereof to attach that suspender strap SS to one of the plurality of belt loops BL on the back of the pair of pants P.

A suspender attachment device 100 in accordance with the present invention may be constructed of any type of any of a variety of materials provided it exhibits sufficient strength and rigidity. For example, a suspender attachment device 100 may be constructed of metal or alloy including steel, stainless steel, aluminum, brass, copper, bronze, titanium, silver, or gold. A suspender attachment device 100 can also be made with one metal or alloy and plated with different type of metal. Alternatively, a suspender attachment device 100 may also be made of plastic or resin. In at least one further embodiment, a suspender attachment device 100 may be painted, coated, or anodized to impart different colors or appearance. In at least one embodiment, the present suspender attachment device 100 comprises a unitary construction, i.e., each of the suspender attachment portion 110, the belt loop interconnect portion 120 and the guide portion 130 are formed integral with one another at the time of construction.

Figure 5:
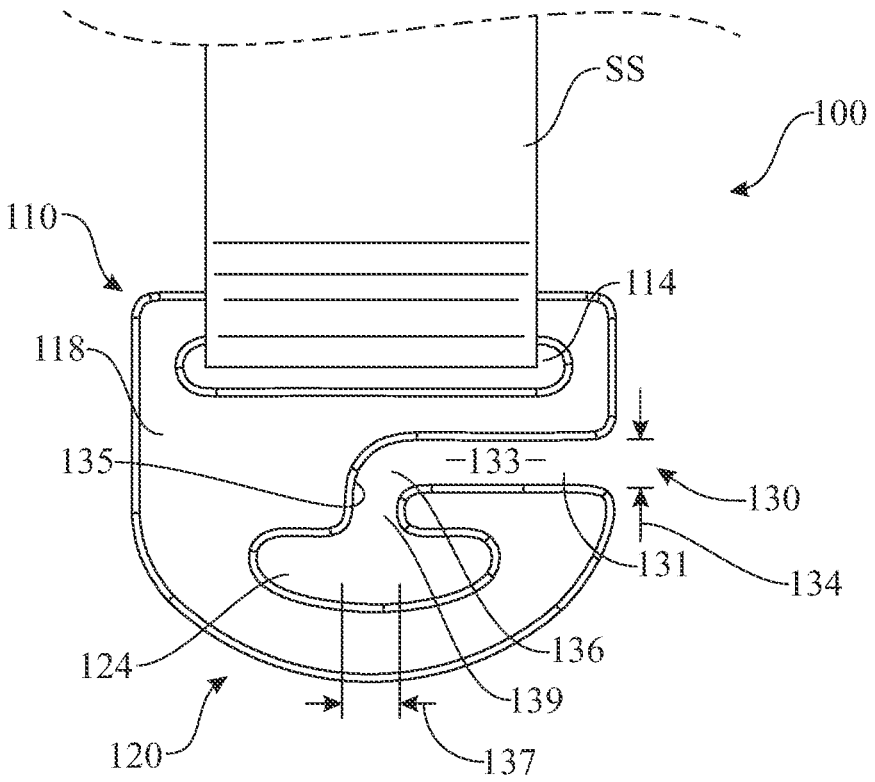
FIG. 5 presents an elevation of a first alternative illustrative embodiment of a suspender attachment device interconnected to one end of a suspender strap, in accordance with the present invention.

Alternative embodiments are contemplated in addition to the embodiments shown and/or described herein. For example, FIG. 5 present an elevation of a first alternative illustrative embodiment of a suspender attachment device 100 in accordance with the present invention. More in particular, the suspender attachment device 100 as shown in FIG. 5 comprises a belt loop attachment portion 120 having a smooth continuous oval shaped configuration. As with the suspender attachment device 100 of FIGS. 1 and 2, the suspender attachment device 100 in FIG. 5 comprises a suspender interconnect portion 110 which is connected to a belt loop attachment portion 120 via an attachment portion interconnect 118. Also similar to the embodiment of FIGS. 2 and 3, a guide portion 130 having a guide channel 131 is disposed in communication with the attachment channel 124 of the belt loop attachment portion 120 is provided to allow a user to quickly and easily attach and release the present suspender attachment device 100 from the belt loops on a pair of pants.

Figure 6:
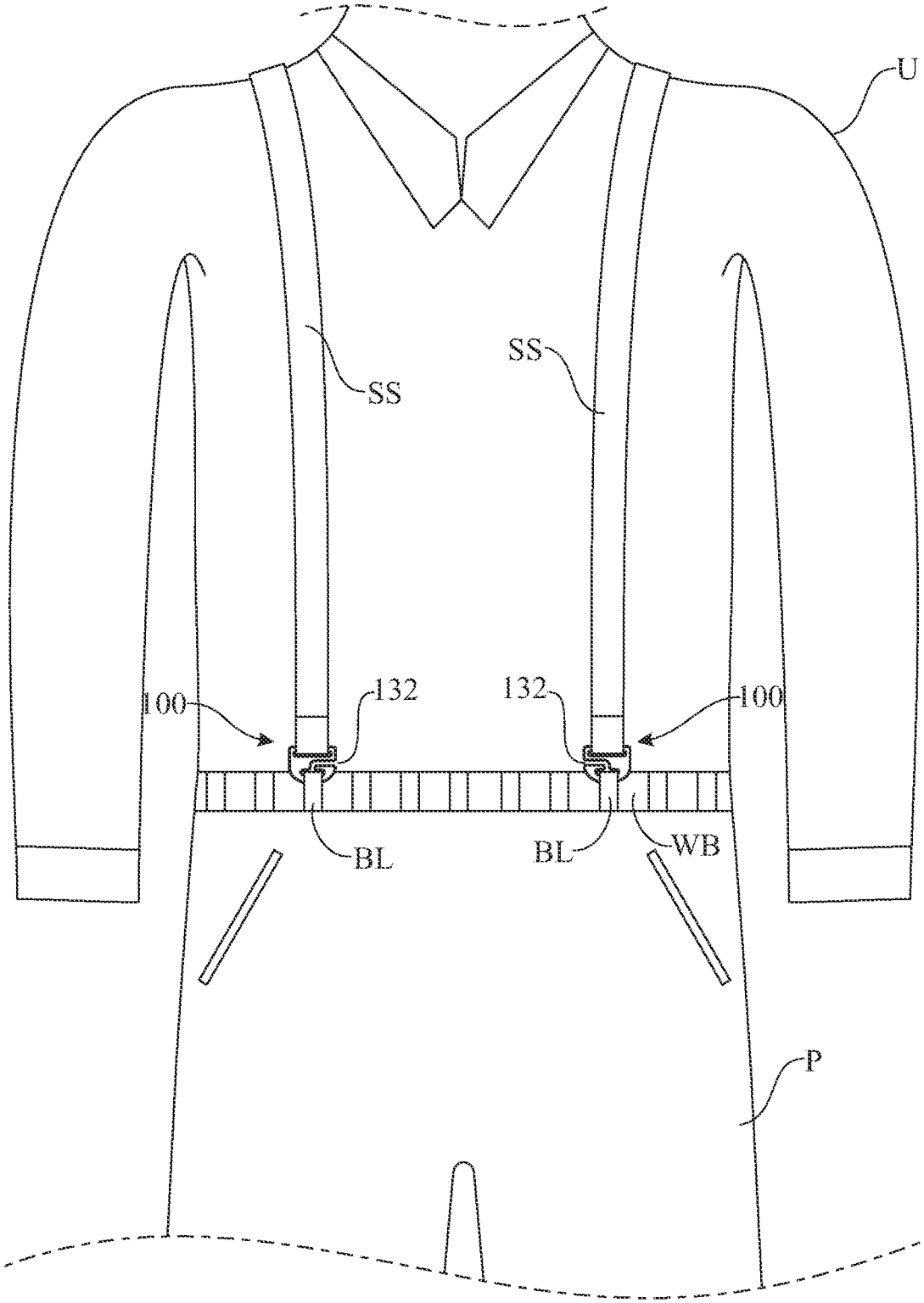
FIG. 6 presents an elevation of a pair of suspender attachment devices as shown in FIG. 5 each attached to a different belt loop on the front of a pair of pants worn by a user, in accordance with the present invention.
Figure 7:
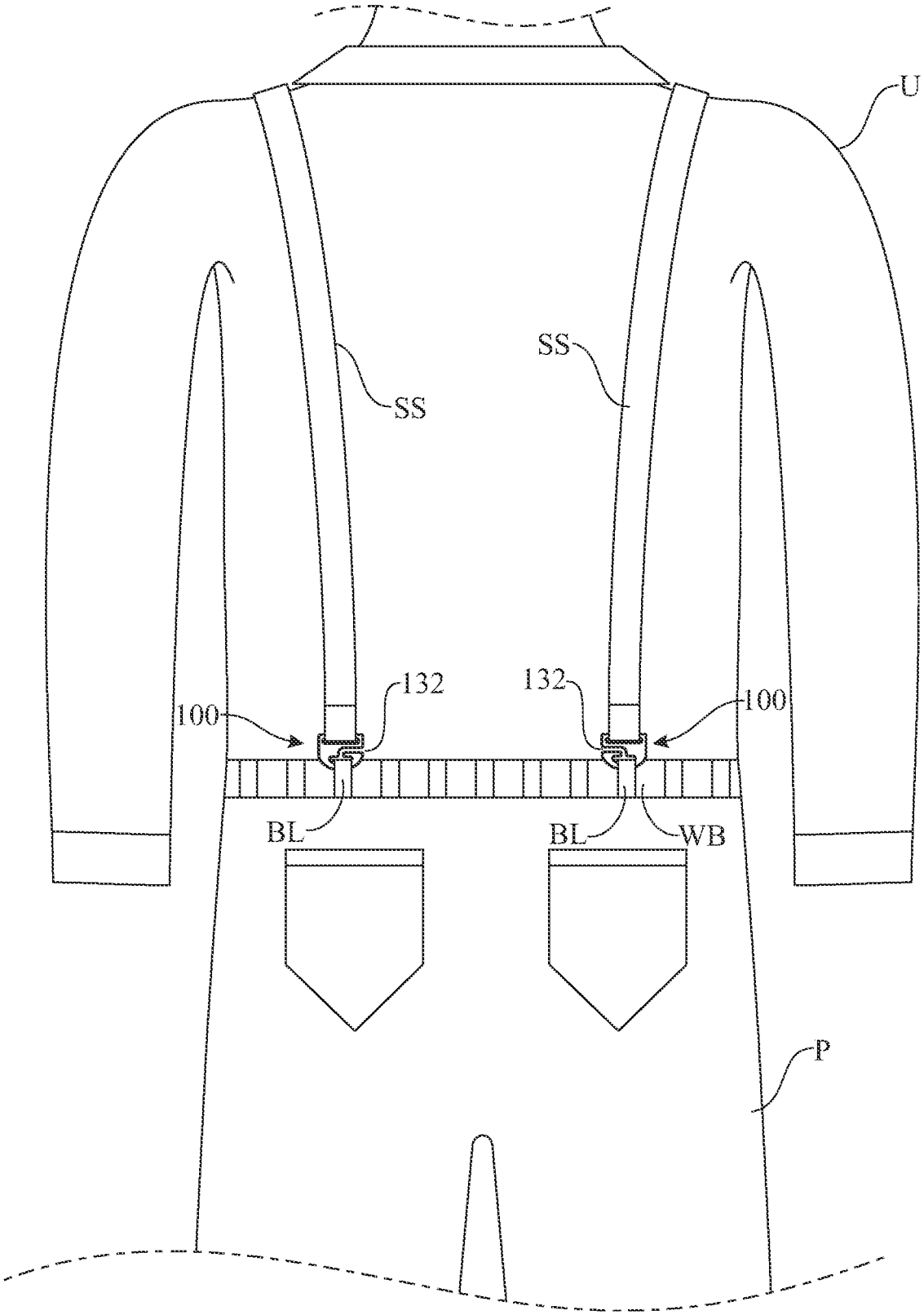
FIG. 7 presents an elevation of a pair of suspender attachment devices as shown in FIG. 5 each attached to a different belt loop on the back of a pair of pants worn by a user, in accordance with the present invention.

Looking next to FIGS. 6 and 7, a pair of suspender straps having a suspender attachment device 100 as shown in FIG. 5 interconnected to respective opposite ends ae shown disposed in position over the shoulders of a user U and attached to different respective ones of the plurality of belt loops BL on the waist band WB of a pair of pants P. As before, in at least one embodiment, it is desirable for the guide channel access 132 of each suspender attachment device 100 to be directed inwardly towards the user's midsection, as this will further serve to prevent inadvertent release of the suspender attachment device 100 from the belt loops.

Figure 8:
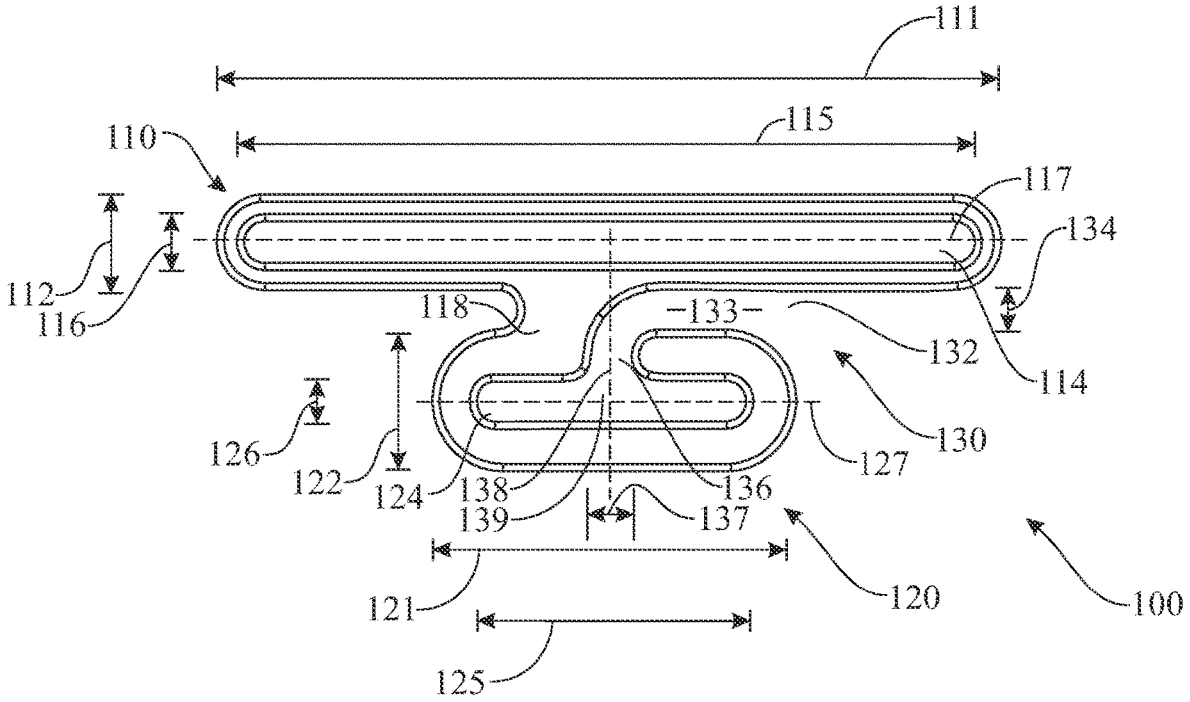
FIG. 8 presents an elevation of a second alternative illustrative embodiment of a suspender attachment device, in accordance with the present invention.

FIG. 8 present an elevation of a second alternative embodiment of a suspender attachment device 100 in accordance with the present invention. As is readily apparent from FIG. 8, this alternative embodiment is provided for use with suspenders having wider suspender straps as the suspender attachment portion 110 has an interconnect channel length 115 which is nearly double the attachment channel length 125 of the belt loop attachment portion 120.

Since many modifications, variations, and changes in detail can be made to the described embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A suspender attachment device interconnected to an end of a suspender strap and operative to securely yet releasably attach the suspender strap to a belt loop on a pair of pants, said device comprising:

a suspender interconnect portion having an interconnect channel dimensioned to receive the end of the suspender strap therethrough and to retain the end of the suspender strap therein, said interconnect channel at least partially defined by an interconnect channel length having an interconnect channel central axis therethrough;

a belt loop attachment portion having an attachment channel dimensioned to receive and releasably retain the belt loop therein, said attachment channel at least partially defined by an attachment channel length having an attachment channel central axis therethrough;

said suspender interconnect portion and said belt loop attachment portion are integrally constructed;

said interconnect channel length is greater than said attachment channel length;

said interconnect channel central axis and said attachment channel central axis are substantially parallel with one another;

a guide portion having a guide channel disposed in communication with said attachment channel, said guide channel dimensioned and configured to facilitate disposition of the belt loop into and out of said attachment channel;

said guide channel having a first guide channel disposed in communication with a second guide channel, wherein said first guide channel having a channel width of between 0.05 of an inch and 0.15 of an inch and said second guide channel having a channel width of between 0.05 of an inch and 0.15 of an inch; and wherein said second guide channel is substantially perpendicular to said first guide channel.

2. The suspender attachment device as recited in claim 1, wherein said suspender attachment device is formed from a sheet of metal.

* * * * *